US009111447B2

(12) United States Patent
Holland

(10) Patent No.: US 9,111,447 B2
(45) Date of Patent: Aug. 18, 2015

(54) EMERGENCY VEHICLE WARNING SYSTEM AND METHOD

(71) Applicant: Kim Tamar Holland, Columbus, NE (US)

(72) Inventor: Kim Tamar Holland, Columbus, NE (US)

( * ) Notice: Subject to any disclaimer, the term of this patent is extended or adjusted under 35 U.S.C. 154(b) by 163 days.

(21) Appl. No.: 13/897,822

(22) Filed: May 20, 2013

(65) Prior Publication Data

US 2014/0070962 A1 Mar. 13, 2014

Related U.S. Application Data

(60) Provisional application No. 61/700,791, filed on Sep. 13, 2012.

(51) Int. Cl.

| | |
|---|---|
| ***G08G 1/00*** | (2006.01) |
| ***G08G 1/16*** | (2006.01) |
| ***G08G 1/0965*** | (2006.01) |
| ***G08G 1/09*** | (2006.01) |

(52) U.S. Cl.

CPC ..... *G08G 1/0965* (2013.01); *G08G 1/094* (2013.01)

(58) Field of Classification Search

CPC ..... G08G 1/0965; G08G 1/094; G08G 1/087; G08G 1/16; G01S 13/931; G60Q 9/008

USPC ..... 340/902, 903, 904, 905, 425.5; 701/301; 455/114.1, 571, 77, 471, 41.2

See application file for complete search history.

(56) References Cited

U.S. PATENT DOCUMENTS

| | | | | | |
|---|---|---|---|---|---|
| 3,876,940 | A * | 4/1975 | Wickord et al. | 455/341 |
| 3,997,868 | A * | 12/1976 | Ribnick et al. | 340/902 |
| 4,287,599 | A * | 9/1981 | Goncharoff et al. | 455/77 |
| 4,764,978 | A * | 8/1988 | Argo et al. | 455/1 |
| 5,422,934 | A * | 6/1995 | Massa | 455/571 |
| 5,635,921 | A * | 6/1997 | Maxwell et al. | 340/902 |
| 5,636,243 | A * | 6/1997 | Tanaka | 375/219 |
| 5,825,304 | A * | 10/1998 | Marin | 340/903 |
| 5,930,729 | A * | 7/1999 | Khamis et al. | 455/571 |
| 6,087,961 | A * | 7/2000 | Markow | 340/902 |
| 7,397,356 | B1 * | 7/2008 | Johnson | 340/471 |
| 2002/0198660 | A1 * | 12/2002 | Lutter et al. | 701/301 |
| 2003/0008626 | A1 * | 1/2003 | Miyano et al. | 455/114 |
| 2003/0141990 | A1 * | 7/2003 | Coon | 340/902 |
| 2003/0164775 | A1 * | 9/2003 | Hutchison et al. | 340/902 |
| 2004/0233045 | A1 * | 11/2004 | Mays | 340/425.5 |
| 2005/0231385 | A1 * | 10/2005 | Haase | 340/905 |
| 2007/0046499 | A1 * | 3/2007 | McKenna | 340/902 |
| 2007/0132609 | A1 * | 6/2007 | Stackelhouse | 340/904 |
| 2007/0159354 | A1 * | 7/2007 | Rosenberg | 340/902 |
| 2007/0281618 | A1 * | 12/2007 | Yokoyama | 455/41.2 |
| 2008/0106435 | A1 * | 5/2008 | Kirkpatrick | 340/902 |

(Continued)

*Primary Examiner* — Hoi Lau

(74) *Attorney, Agent, or Firm* — Michael D. Eisenberg

(57) ABSTRACT

An aspect of some embodiments of the present invention relates to a warning system for use in an emergency vehicle. The system comprises a tone generator, configured for generating an output alert signal, and a radio wave generator. The radio wave generator is configured for receiving the output alert signal and encoding the output alert signal into an electrical signal, and for converting the electrical signal into an electromagnetic wave configured for being received by a radio and/or a cellular communication device within a desired distance from the emergency vehicle, thus enabling the receiving radio and/or cellular communication device to convert the electromagnetic wave to an audio signal that can be emitted by the radio and/or cellular communication device to warn a user of a proximity of the emergency vehicle.

20 Claims, 9 Drawing Sheets

(56) References Cited

U.S. PATENT DOCUMENTS

2010/0001879 A1* 1/2010 Boscacci ..... 340/903
2011/0018736 A1* 1/2011 Carr ..... 340/902
2012/0249341 A1* 10/2012 Brown et al. ..... 340/902
2012/0313792 A1* 12/2012 Behm et al. ..... 340/902
2014/0070962 A1* 3/2014 Holland ..... 340/902

* cited by examiner

EMERGENCY VEHICLE WARNING SYSTEM AND METHOD

CROSS-REFERENCES TO RELATED APPLICATIONS

This application claims priority from U.S. Provisional Application Ser. No. 61/700,791 filed on Sep. 13, 2012, which is hereby incorporated herein by reference in the respective in its entirety.

TECHNICAL FIELD

The present invention, in some embodiments thereof, relates to electronic warning devices, and more specifically, to warning devices configured for warning motorists of the approach of an emergency vehicle.

BACKGROUND OF THE INVENTION

In many countries, the law requires motorists to move to a side of the road when an emergency vehicle with an operating siren approaches, as soon as the motorists are able to do so in a safe manner. Often, emergency vehicles are slowed while en route to a dispatched location by motor vehicles the operators of which do not respond to the approaching emergency vehicle for reasons which might include lack of hearing the siren (i.e. windows rolled up) or distractions such as a radio playing, talking on a cell phone or listening to a CD/DVD player.

Many systems and methods have been devised to alert motorists of an approaching emergency vehicle en route to a dispatched location.

U.S. Pat. No. RE 38,763 discloses a system and method for alerting a driver of a motor vehicle of the approach of an emergency vehicle in an emergency state, comprising a transmitter in the emergency vehicle which produces and transmits a radio frequency signal having a unique audio encoded data signature modulated thereon when the emergency vehicle is in an emergency status, a receiver in a motor vehicle which receives the radio frequency signal, demodulates and decodes the radio frequency signal and produces a voltage output when the data signature is present; and an alarm producing device which produces an alarm in response to the voltage output warning the driver of the motor vehicle of the approach of the emergency vehicle.

U.S. Pat. No. 6,822,580 discloses a warning system for alerting the driver of a private vehicle that an emergency vehicle is approaching. The system includes a receiver and a display panel mounted in the private vehicle, and at least two infrared receivers mounted on the private vehicle. The display panel mounted in the private vehicle including indicating devices that allow the driver of the private vehicle to know of the approaching emergency vehicle as well as the direction to move in order to yield the right of way to an approaching emergency vehicle; and a warning signal emitting device mounted in the emergency vehicle, the warning signal emitting device providing signals that allow the components of the emergency vehicle warning system mounted in the private vehicle to know that the approaching vehicle is an emergency vehicle.

U.S. Pat. No. 6,252,521 discloses an emergency vehicle alert system that includes transmitter units mountable within emergency vehicles and receiver units mountable within civilian vehicles. The transmitter units and the receiver units via a mechanism within each receiver unit that provides each civilian driver with an indicator of the distance between his/her civilian vehicle and the emergency vehicle.

U.S. Pat. No. 5,959,551 discloses an invention for use in warning motorist, especially those who are hearing impaired, of an approaching emergency vehicle. The invention comprises a transmitter which is installed into an emergency vehicle and activated upon an emergency run. A low frequency signal is sent out over the emergency vehicles original equipment antenna system and is picked up by motorist having a receiver unit mounted to their dash panel. The signal is processed into visual and audio warnings whenever a transmitting emergency vehicle is within close proximity to the receiving vehicle. The receiver is on full time when the motor vehicle is in operation thereby allowing suitable response time for motorist to take appropriate action in yielding to the emergency vehicle. The transmitter does however have an on/off switch as well as a visual and audio means for monitoring the transmitted signal.

U.S. Pat. No. 6,160,493 discloses a low-cost and reliable radio warning system that alerts system users of potential hazardous conditions is disclosed. The system makes use of a transmitter and at least one receiver. The transmitter generates and transmits a radio warning signal that carries a digital data sequence that includes information concerning a particular potential hazardous condition from which the transmission was initiated, such as an approaching ambulance, fire truck, bus, train, or the like. Other information, such as GPS coordinates, may also be included. Through the use of digital encoding techniques, the system's susceptibility to false alarms or "false triggers" is minimized. The radio warning signal is transmitted in burst transmissions and may use a number of signaling techniques, including spread spectrum transmission, which increases system reliability and performance even in the presence of interference or multipath distortion. System users are equipped with a receiver that receives the radio warning signal and interprets the digital data and information carried by the warning signal. The receiver alerts the system user who has received the radio warning signal of the potential hazardous condition through the use of an audible, visual or tactile alarm.

U.S. Pat. No. 7,236,101 discloses a warning system for making known the presence of an emergency vehicle. A transmitter is mounted in an emergency vehicle that outputs a digital UHF/LMS signal that is detectable within a range. A receiver responds to the digital UHF/LMS signal from the transmitter and is mounted, most preferably to a dashboard of a motor vehicle. The receiver detects from the digital signal the type of emergency vehicle from which the digital signal is originating. In one embodiment the digital signal also includes a unique identifier for the transmitter rather than simply a generic discipline identifier such as police, fire, emergency etc. A visual indicator mounted to the motor vehicle is activated in response to the digital signal from the transmitter to warn a motorist in the motor vehicle of a presence of the emergency vehicle within the range of the transmitter and to warn the transmitting vehicle of the presence of other emergency vehicles within receiving range.

BRIEF SUMMARY OF EMBODIMENTS OF THE INVENTION

Generally, the systems known in the art and described in the above-mentioned patent publications include a radio frequency transmitter within the emergency vehicle and a receiver within a motorist's vehicle. The radio frequency transmitter emits a warning signal, which is received by the receiver. The receiver warns the motorist of the emergency vehicle's approach. Thus, for implementing the above-described systems, some type of action (i.e. equipment purchase, aftermarket equipment installation, etc.) is necessary in order to outfit the motorist's vehicle with the receiver. These actions require some kind of expense, and may ultimately reduce the value of the motorist's vehicle when the receiver is removed during a modification of the vehicle.

There is therefore a need for a technique for informing motorists of an approaching emergency vehicle, without requiring the motorists to install a receiver in their vehicles.

The present invention fills this need, by providing a warning system installed on the emergency vehicle alone. The warning system emits a signal, which is received by a pre-existing device owned by the motorist. The motorist's device may a radio or a cellular phone. The warning system of the present invention thus includes a radio wave emitting device and/or a cellular communication device.

The radio signal emitting device emits a radio wave at a plurality of frequencies, so that motorists listening to different radio stations can be warned of the approach of the emergency vehicle. The strength of the radio signal is chosen to affect only radios operating within a predetermined radius from the emergency vehicle.

The cellular communication device is in communication with a cellular network, and is equipped with a positioning system configured for generating data indicative of the position of the emergency vehicle. The cellular communication device emits a wave which includes data indicative of the emergency vehicle's position and of a tone to be played to one or more receiving cellular phones. This enables the cellular network to operate only the antenna(s) near the emergency vehicle, such that the tone is sent only to one or more cellular phones operating within a desired radius of the emergency vehicle.

An aspect of some embodiments of the present invention relates to a warning system for use in an emergency vehicle. The system comprises a tone generator, configured for generating an output alert signal, and a radio wave generator. The radio wave generator is configured for receiving the output alert signal and encoding the output alert signal into an electrical signal, and for converting the electrical signal into an electromagnetic wave configured for being received by a radio and/or a cellular communication device within a desired distance from the emergency vehicle, thus enabling the receiving radio and/or cellular communication device to convert the electromagnetic wave to an audio signal that can be emitted by the radio and/or cellular communication device to warn a user of a proximity of the emergency vehicle.

In some embodiments of the present invention, the radio wave generator comprises a radio signal generator and an antenna device. The radio signal generator is configured for generating an oscillating radio frequency electric current having a frequency chosen to match a broadcasting frequency of a radio station, and for encoding the alert single in the oscillating radio frequency electric current, thus generating a radio signal. The antenna device is configured for receiving the radio signal and converting the radio signal into the respective electromagnetic wave, the electromagnetic wave being a radio wave configured for being converted to the audio signal by a radio tuned to the radio station.

In a variant, the radio signal generator is configured for generating a plurality of oscillating radio frequency electric currents of different frequencies, each of the different frequencies matching a corresponding frequency of one of a plurality of radio stations, and for encoding the alert single in each of the oscillating radio frequency electric currents, thus generating one or more radio signals. The antenna device is configured for receiving the radio signals and converting the radio signals into the respective electromagnetic waves, the electromagnetic waves being radio waves configured for being converted to the audio signals by a radio tuned to one of the plurality of radio stations.

In another variant, the radio signal generator comprises: a frequency scanner, configured scanning a certain range of frequencies of radio waves, and recognizing one or more operating frequencies corresponding to one or more of the broadcast frequencies of one or more of the radio stations; a frequency synthesizer, configured for receiving from the frequency scanner data indicative of the one or more operating frequencies, and for generating one or more electric signals having the one or more operating frequencies; a transmitter, configured for receiving the one or more electric signals from the frequency synthesizer and for generating respective one or more transmission signals having a desired power; a mixer for receiving the alert signals and the one or more transmission signals and for encoding the alert signals into the one or more transmission signals, thus generating one or more modulated broadcast carrier signals, the one or more modulated broadcast carrier signals being used for producing one or more of the radio signals.

In yet another variant, the radio signal generator further comprises a power amplifier, configured for amplifying the one or more carries signals to generate and output the one or more radio signals.

In a further variant, the radio signal generator includes a plurality of frequency scanners configured for simultaneously scanning respective sections of the desired range of frequencies.

In yet a further variant, the plurality of frequency scanners is configured for scanning the respective sections of a single frequency band or of a plurality of frequency bands.

Optionally, the radio signal generator comprises a plurality of transmitters and mixers. The frequency synthesizer is configured for receiving the data indicative of the operating frequencies from the frequency scanners and alternately transmitting the electric signals to the plurality of transmitters. Each of the plurality of transmitters is configured for creating the respective transmission signal. Each of the mixers is configured for receiving the transmission signal from a respective one of the transmitters, and generating the respective modulated broadcast carrier signal.

In a variant, the radio signal generator comprises a plurality of frequency synthesizers, configured for receiving the data indicative of the operating frequencies from the corresponding frequency scanners, the frequency scanners simultaneously transmitting the electric signals to the respective plurality of transmitters.

In another variant, the radio signal generator comprises a plurality of isolation units, each isolation unit being configured for receiving a respective one of the carrier signals from the respective mixer, and for isolating the respective carrier signal from one or more carrier signal generated by other mixers.

Optionally, the warning system includes a plurality of radio signal generators, each configured for producing one or more radio signals. The antenna device comprises a plurality of antennas, each antenna configured for receiving the radio signal from a respective one of the radio signal generators and for converting the radio signal into the respective electromagnetic wave.

Optionally or alternatively, the warning system includes a plurality of radio signal generators, each configured for producing one or more radio signals, and a plurality of antenna matches configured for matching an output impedance of the respective radio signal generator to an input impedance of an antenna diplexer. The antenna device includes the antenna diplexer and an antenna, the antenna diplexer being configured for receiving the signals from the antenna matches and combining the received signals for simultaneous or near-simultaneous broadcast over the antenna.

In some embodiments of the present invention, the radio wave generator comprises a cellular communication module comprising a position tracker and a cellular transmitter. The position tracker is configured for generating position data indicative of the instantaneous location of the emergency vehicle. The cellular transmitter is configured for: generating an electric signal having a specific frequency matching the receiving frequency of a cellular network; encoding the alert signal and position signal into electric signal to produce an encoded cellular signal; and converting the encoded cellular signal into the respective electromagnetic wave. The electromagnetic wave is configured for being received by the cellular network, enabling the cellular network to extract the position data, and in response to the position data retransmit the electromagnetic wave via one or more cellular antennas located in an immediate geographical location of the emergency vehicle, such that one or more cellular communication devices located within a certain distance from the emergency vehicle are able to receive the retransmitted electromagnetic wave and convert the retransmitted electromagnetic to the audio signal.

In a variant, the tone generator comprises a waveform generator, configured for creating a first alert signal having a first time profile; and a filter, configured for receiving the first alert signal and changing the first time profile, in order to output a desired second alert signal having a desired second time profile, the second alert signal being used for producing the output alert signal.

In another variant, the tone generator further comprises a decay generator, configured for introducing a decay in the second alerts signal to generate the output alert signal.

In some embodiments of the present invention, the warning system further comprises a power supply configured for receiving an input power signal from a power system of the emergency vehicle, and manipulating the input power signal to provide suitable operating power to one or more elements of the warning system.

In a variant, the power supply comprises: a transient suppression unit, configured for attenuating one or more voltage spikes of the input power signal, to output a first power signal; and a DC-DC converter, configured for receiving the first power signal, and for generates therefrom a plurality of output power signals of operating voltages suitable for powering the different elements of the warning system.

In another variant, the power supply further comprises a high-frequency suppression unit connecting the transient suppression unit and the DC-DC power converter, the high-frequency suppression unit being configured for filtering the first power signal, by suppressing one or more high frequency noise signals and transmitting the filtered first power signal to the DC-DC converter. The DC-DC converter is configured for generating the plurality of output power signals from the filtered first power signal.

In yet another variant, the power supply further comprises one or more filters, each applied to a respective output power signal of the DC-DC converter, each filter being configured to attenuate generated and induced noise signals in the respective output power signal.

Another aspect of some embodiments of the present invention relates to a method for generating a warning indicative of a proximity of an emergency vehicle, the method comprising: generating an output alert signal; encoding the output alert signal into an electrical signal; and converting the electrical signal into an electromagnetic wave configured for being received by a radio and/or a cellular communication device within a desired distance from the emergency vehicle, thus enabling the receiving radio and/or cellular communication device to convert the electromagnetic wave to an audio signal that can be emitted by the radio and/or cellular communication device to warn a user of a proximity of the emergency vehicle.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1A:
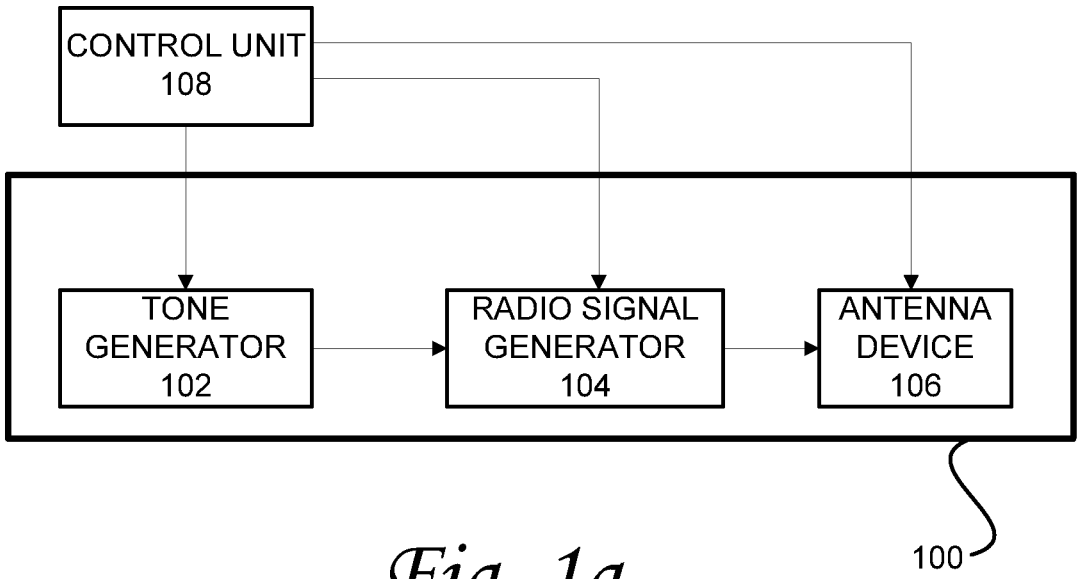
FIGS. 1*a*-1*c* are block diagrams illustrating different embodiments of a warning system of the present invention, in which the warning system may transmit signals receivable by radios and/or cellular phones, and optionally by a dedicated receiver.
Figure 1B:
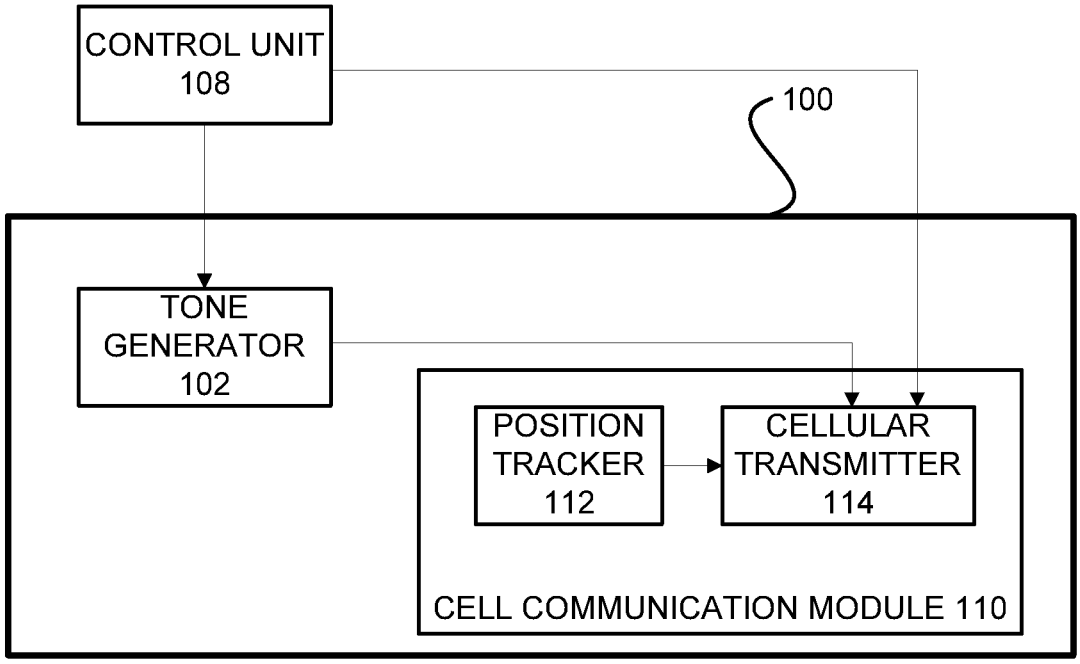
Figure 1C:
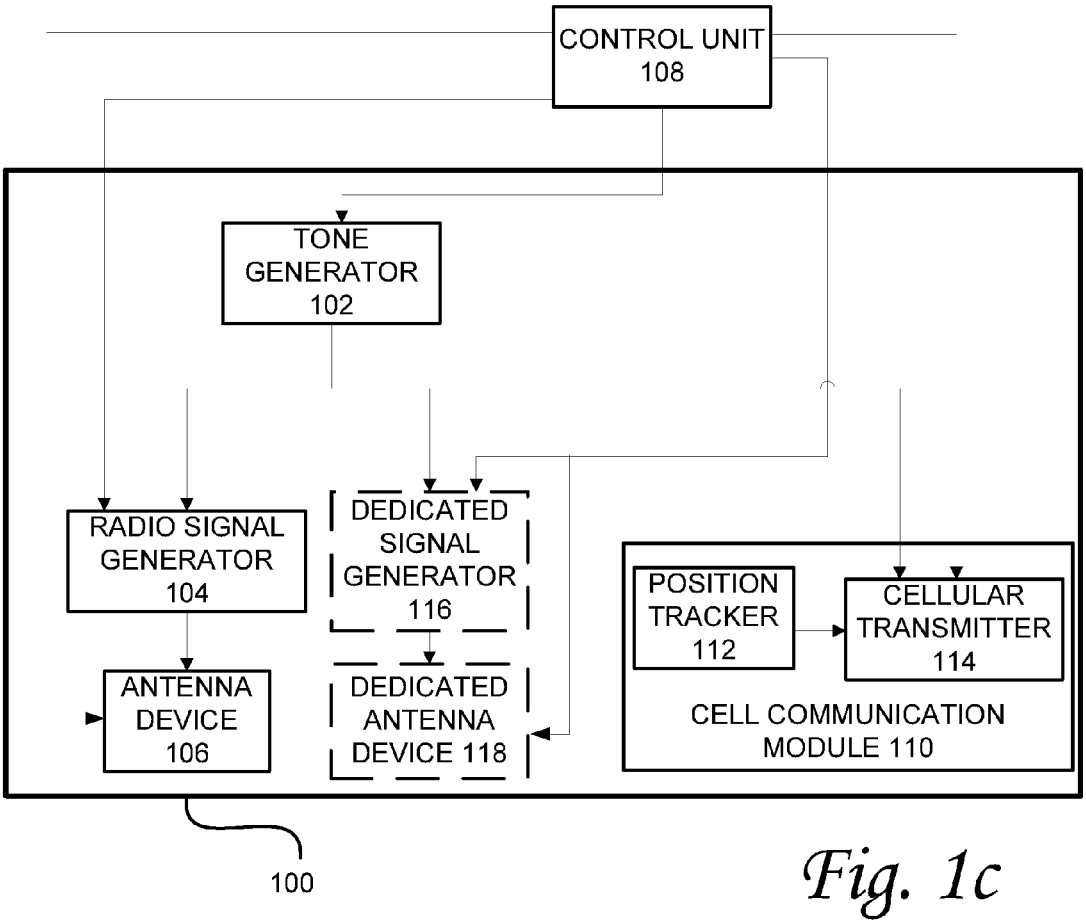

Referring now to the figures, FIGS. 1*a*-1*c* are block diagrams illustrating different embodiments of a warning system 100 of the present invention, in which the warning system may transmit electromagnetic waves receivable by radios and/or cellular phones, and optionally by a dedicated receiver.

In FIG. 1*a*, the warning system 100 is configured for being joined to an emergency vehicle (ambulance, police car, fire engine, etc.) and emitting a plurality of radio waves configured for being received by a radio (e.g. AM or FM) and for introducing a tone in the audio emitted by the radio, in order to warn the motorist of the approach of an emergency vehicle. In the example of FIG. 1*a*, the warning system 100 includes a tone generator 102, a radio signal generator 104, and an antenna device 106. An operation of some or all of these elements may be controlled by a control unit 108, which may be a part of the system 100 or may be external to the system 100.

Upon receipt of a certain initiation signal, the control unit 108 begins a cycle of issuing commands to the tone generator 102, radio signal generator 104, and an antenna device 106. Responsive to these commands, the tone generator 102 generates an alert signal that is indicative of and can be translated into an audio tone to be emitted by a receiving radio. The alert signal is generally generated via a waveform generator included in the tone generator. The alert signal is transmitted to the radio signal generator 104, which (as instructed by the control unit) generates one or more oscillating radio frequency electric currents (hereafter referred to as radio signals) having different frequencies. The frequencies are chosen to match the frequencies of one or more radio stations. The signal generator 104 encodes the alert signal in the one or more radio signals, so that a receiving radio tuned into the corresponding radio station(s) can decode the signals and emit the tone as an audio wave.

The one or more radio signals are received by the antenna device 106, which converts the one or more radio signals into one or more respective radio waves, and emits the one or more radio waves. It is preferable that a plurality of radio signals is generated and a plurality of radio waves is emitted, so that different radios set to different receiving frequencies (different radio stations) are able to receive a radio wave matching the receiving frequency and converting the radio wave to an audio signal. In this manner, a motorist may listen to any one of a plurality of radio channels, and will still be exposed to the warning tone, when the emergency vehicle is within a certain range.

In FIG. 1*b*, the system 100 is configured for emitting one or more cellular waves, to connect to a cellular network, thus being able to transmit the warning tone to cellular telephones. The tone generator 102 generates an alert signal that is indicative of and can be translated into an audio tone to be emitted by a receiving cellular communication device (e.g. cellular phone). The system 100 of the example of FIG. 1*b* thus includes a cellular communication module 110, configured for receiving the alert signal from the tone generator 102, and emitting a radio frequency wave (cellular wave) configured for being received by the cellular network.

The cellular communication module 110 includes a position tracker 112 and a cellular transmitter 114. The cellular communication module 110 section may be a purchased module that is a complete communications device that operates on standard dual-band platform. The position tracker 112 is configured for generating position data indicative of the instantaneous location of the emergency vehicle. The position tracker 112 may be, for example, a global positioning system (GPS) receiver or any other kind of satellite-based positioning receiver.

The position data and the alert signal are received by the cellular transmitter 114, which generates an electrical signal having a specific frequency matching the receiving frequency of a cellular network (these signals will be hereafter called cellular signals). The cellular transmitter 114 encodes the alert signal and the position data in the cellular signal and converts the encoded cellular signal into an electromagnetic (generally radio-frequency) wave (hereafter called cellular wave) configured for being received by a cellular network. In this manner, the cellular network is able to receive the cellular wave and extract therefrom the position data. In response to the position data, only the cell towers (antennas) located in the immediate geographical location of the system 100 (and therefore of the emergency vehicle) will respond to this cellular wave and retransmit the cellular wave to the subscribers (e.g., motorists) located within a certain distance from the emergency vehicle. Optionally, the cellular wave is only retransmitted by the cellular network to off-hook phones.

Optionally, the warning system 100 sends a common response number telephone call (i.e. 911, etc.) that cell phones will receive and process as an incoming call. In a variant, this call is in the form of the tone and is generated as an incoming call waiting indication to the person using the phone. In this manner, the tone is superposed to the audio of the user's phone call. Thus, the phone call is not interrupted, but the user is warned of the approach of the emergency vehicle. In some embodiments of the present invention, the cellular wave retransmitted by the cellular network carries a data packet which includes the position data of the emergency vehicle. Thus, phones with GPS capability may also display the location of the emergency vehicle to the user.

In FIG. 1*c*, the warning system 100 includes both the radio signal generator 104 and its corresponding antenna device 106, and the cellular communication module 110. Thus, in this example, the warning system is able to warn motorists listening to the radio and motorists operating a cellular phone.

Figure 9:
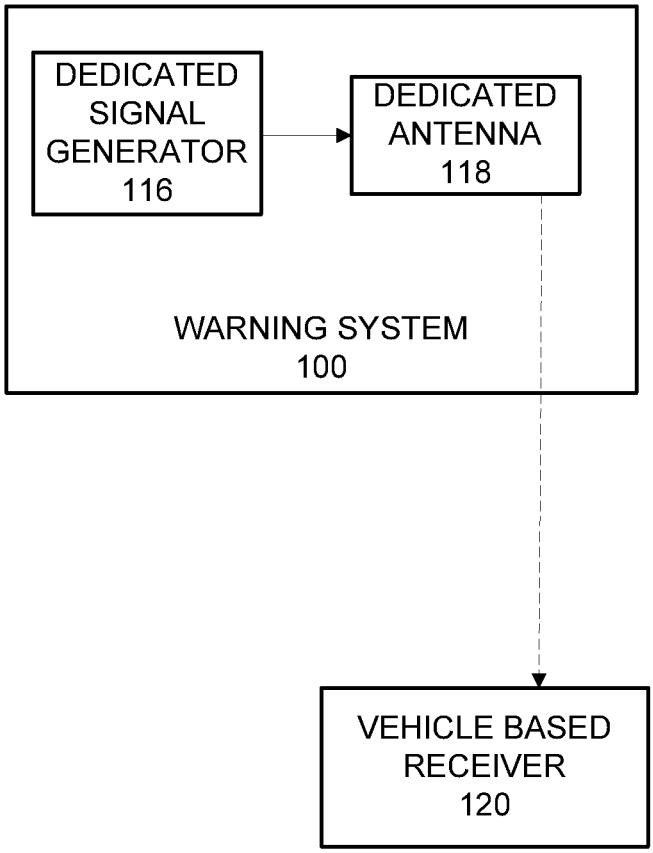
FIG. 9 is a block diagram illustrating an example of the warning system of the present invention, which includes a dedicated signal generator and a dedicated antenna, configured for emitting a signal which is to be detected by a dedicated vehicle-based receiver.

Optionally, the warning system 100 includes a dedicated signal generator 116 and a dedicated antenna device 118. The dedicated signal generator 116 is configured for encoding the alert signal into a dedicated signal, while the dedicated antenna device 118 is configured for transforming the dedicated signal into a dedicated electromagnetic (typically radio-frequency) wave, and emitting the dedicated wave. As shown in FIG. 9, the dedicated wave is configured for being received by a dedicated vehicle-based receiver 120, which may be installed in one or more vehicles. The addition of the dedicated signal generator 116 and a dedicated antenna device 118 to the system 100 may be used to warn motorists who are not listening to the radio or motorists who do not own or are not operating a cellular phone. This may include motorists listening to audio stored a compact-disc (CD) or watching a video stored on a digital versatile disc (DVD).

In the examples of FIGS. 1*a*-1*c*, the control unit 108 may include a microcontroller unit (MCU), and may issue commands to the different elements of the system 100 via an integrated universal serial bus (USB) port. The MCU may manage the operation of the system 100 according to a software code running thereon. Optionally, the control unit 108 includes logic circuits designed to manage the system's operation without software instruction. In some embodiments of the present invention the control unit 108 includes one or more MCUs and one or more logic circuits, so that the operation of the control unit 108 is performed by a combination of software-based and hardware-based instructions.

In some embodiments of the present invention, the control unit 108 operates to constantly monitor for the initiation signal to become active. When this signal is detected, the control unit 108 issues pre-coded commands via a system data communication bus to generate the alert signal and to operate the different elements of the system 100. The initiation signal may be any signal that indicates that the emergency vehicle is en route to a dispatched location. For example, the control unit may be connected to the siren, so that the same electrical signal that turns on the siren is the initiation signal for the control unit. According to another example, the control unit is connected to the speedometer, so that an initiation signal is generated when the emergency vehicle reaches a certain speed, even if the siren does not operate.

Optionally, the control unit 108 includes a communication port connected to a user interface, which allows a user (i.e., the operator of the emergency vehicle or a person responsible for the maintenance of the emergency vehicle) to use the user interface to initiate or terminate the operation of the system 100. In a variant, the control unit 108 is preprogrammed (via software and/or logic units) to interpret one or more specific conditions (e.g., operation of a siren, speed above a threshold) as the initiation signal. In another variant, the user interface allows a user to define the conditions that are to be interpreted as an initiation signal.

Figure 2:
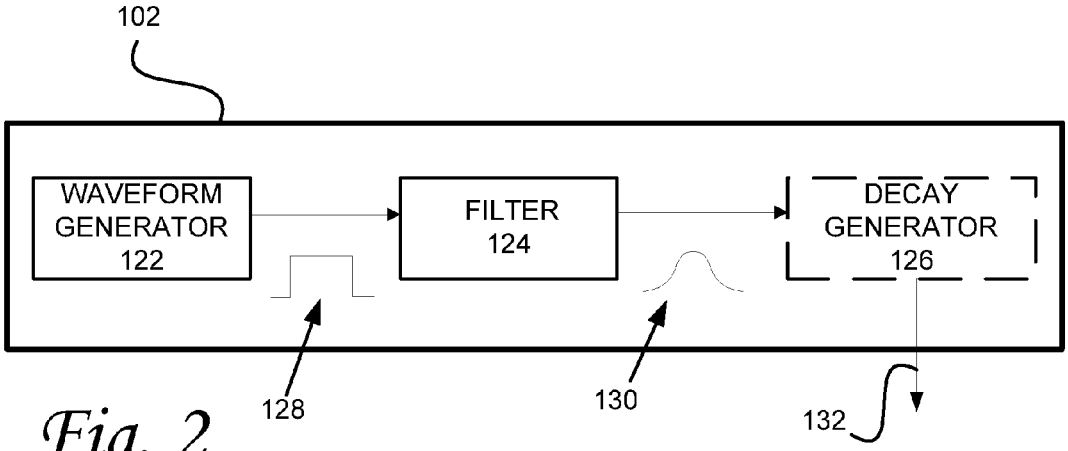
FIG. 2 is a block diagram illustrates an example of a tone generator, according to some embodiments of the present invention.

FIG. 2 is a block diagram illustrates an example of a tone generator 102, according to some embodiments of the present invention.

In some embodiments of the present invention, the tone generator 102 includes a waveform generator 122, a filter 124, and optionally a decay generator 126. The waveform generator 122 is known in the art and includes an electronic oscillator capable of creating a repetitive waveform, such as a sine wave, sawtooth wave, step (pulse) wave, square wave, or triangular wave. The repetitive waveform generated by the waveform generator 122 is used as a first alert signal 128 indicative of a warning tone. It should be noted that in case the control unit 108 of FIGS. 1*a*-1*c* include an MCU, the waveform generator may be incorporated in the MCU itself.

The filter 124 is configured for receiving the first alert signal 128 and changing a time profile (waveform) thereof, in order to output a desired second alert signal 130 having a desired time profile. The decay generator 126, if present, receives the second alert signal and is configured for introducing a decay to the second alert signal, so that the tone emitted by the receiver (radio, cell phone, dedicated receiver) is not persistent, but decays over time, like a chime. The decay generator 126 includes one or more electronic units known for producing signal decay, such as a digital potentiomenter, a voltage control amplifier, or a digitally control amplifier, for example.

According to a non-limiting example, the alert signal generated by the signal generator 122 is a 1200 Hz square wave 128. When converted to an audio signal, the square wave is very harsh to the human ear because it contains a plurality of harmonics (additional frequencies that are multiples of the fundamental 1200 Hz tone). The filter 124 may include a third order Butterworth Low Pass Filter, which removes the higher order harmonics resulting in a second alert signal 130 in the form of or approximating a sine wave of the original fundamental frequency. The second alert signal 130 may be applied to the decay generator (signal level control) 126, that creates a decay in the second alert signal, so that the alert tone achieved when the second alert signal is translated into audio emulates a chime. The final (filtered and decaying) signal 132 output by the decay generator 126 is sent to the one or more transmitting units (radio generating unit, cellular communication module, dedicated signal generator) as the alert signal.

Figure 3:
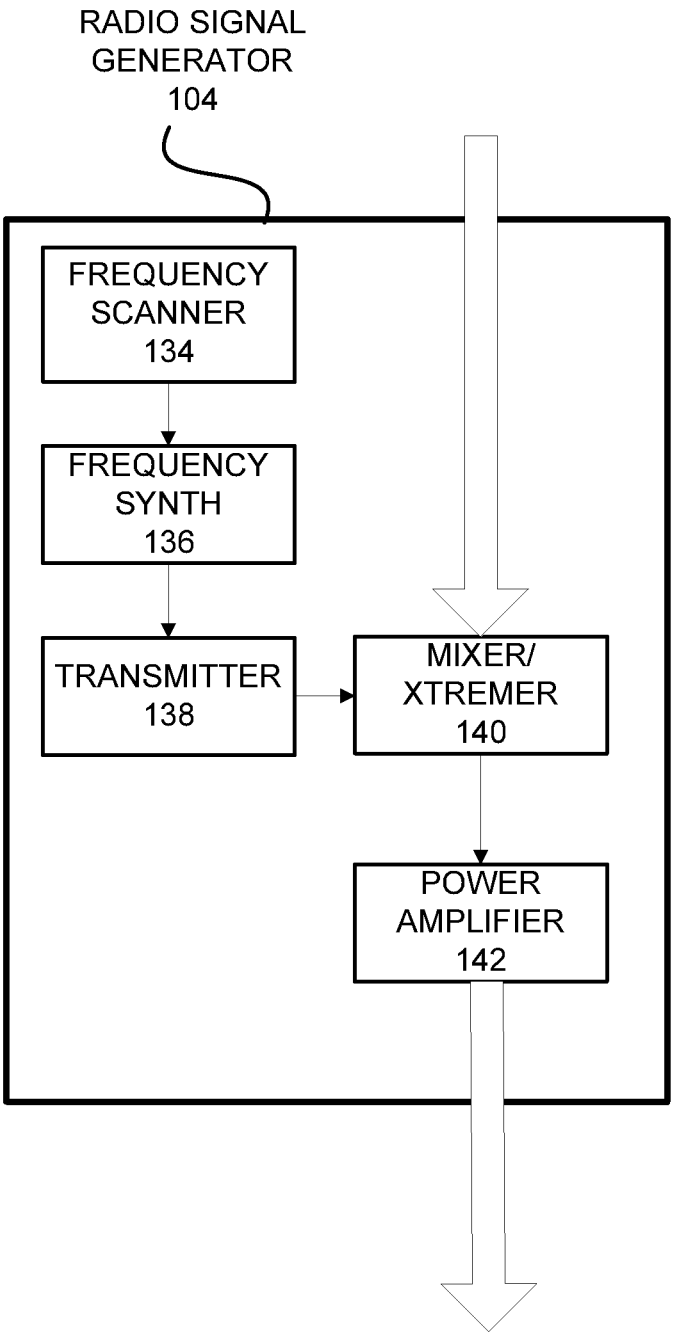
FIGS. 3 and 4 are block diagrams illustrating different examples of a radio signal generator, according to some embodiments of the present invention.
Figure 4:
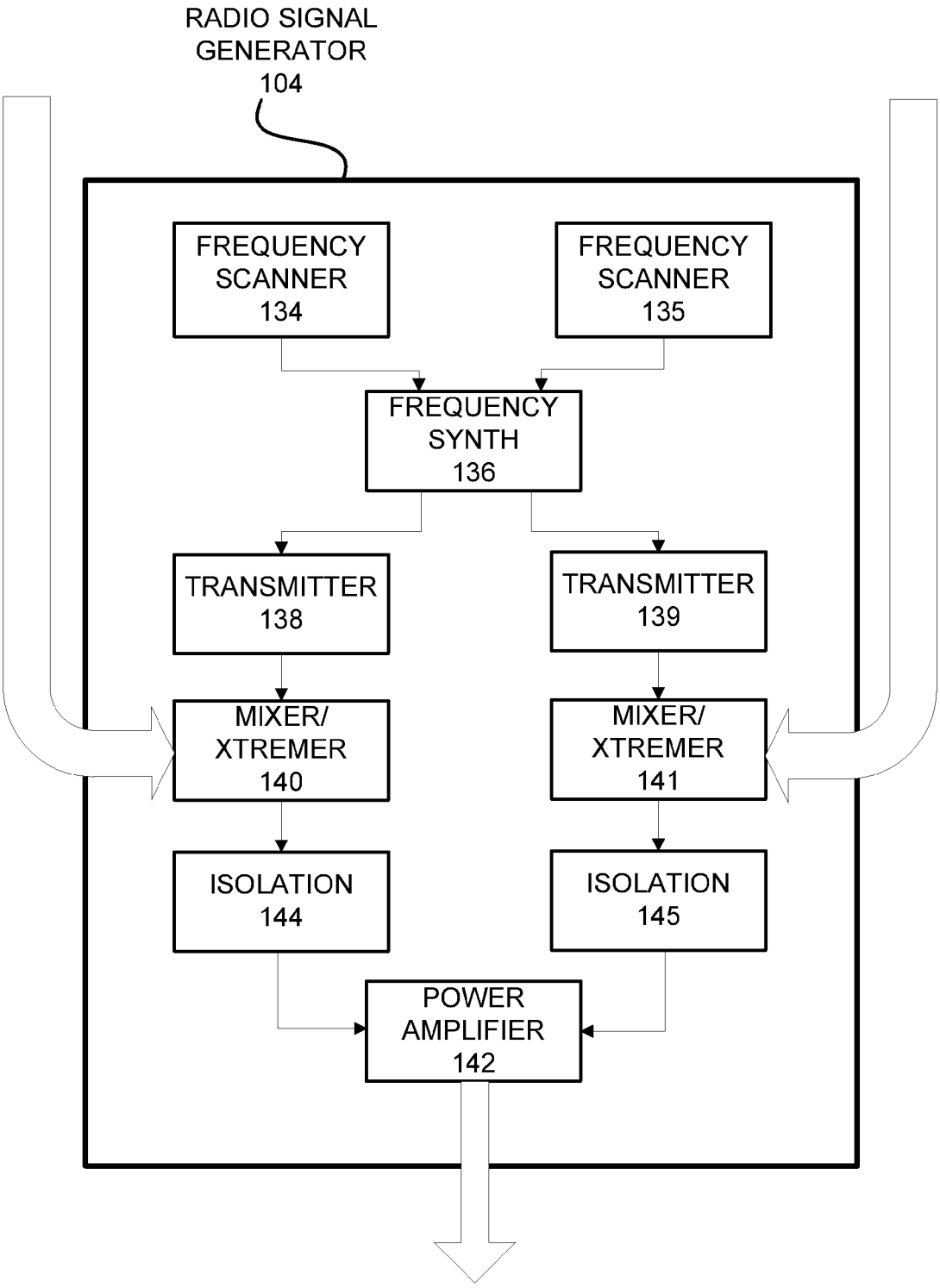

FIGS. 3 and 4 are block diagrams illustrating different examples of a radio signal generator 104, according to some embodiments of the present invention. In both these figures, the radio signal generator 104 is configured for scanning a desired range of frequencies (e.g., part of or all of the FM band or AM band), detecting operating frequencies corresponding to one or more broadcast channels (radio stations) within the scanned range, generating one or more radio signals in which the alert signal is encoded at the operating frequencies, and transmitting the one or more radio signals to the antenna device 106 of FIGS. 1*a* and 1*c*.

As mentioned above, it is preferable that a plurality of operating frequencies corresponding to a plurality of radio stations is detected, and accordingly a plurality of radio signals is transmitted to the antenna device. In this manner, any radio tuned into one of the detected radio stations can receive the alert signal and emit the tone. Optionally, the dwell time for each channel (i.e., the time in which the alert signal is emitted in a wave having the channel's frequency) is short (e.g. 3 seconds). In this manner, a desired number (e.g., two, three, etc.) of alert tone bursts may be heard by a motorist for each complete scan while the emergency vehicle is in the motorist's vicinity, no matter which radio station the motorist may be listening to. Because the approach and passing of the emergency vehicle occurs in a brief period of time, rapid scanning of the radio band is desirable.

In the example of FIG. 3, the radio signal generator 104 includes a frequency scanner 134, a frequency synthesizer 136, a transmitter 138, a mixer 140, and an amplifier 142.

The frequency scanner 134 is designed for scanning a certain range of frequencies of radio waves, and for recognizing operating frequencies corresponding to the one or more broadcast channels (radio stations) within the scanned range. The frequency scanner may include a receiving circuit and an electronic scanner. The receiving circuit receives radio waves, and the frequency scanner is configured for applying a voltage to the receiving circuit, in order to vary the capacitance and/or inductance of the receiving circuit and thus detect the operating frequencies corresponding to the one or more broadcast channels (radio stations). The frequency synthesizer 136 receives data indicative of the one or more operating frequencies from the frequency scanner 134, and generates one or more electric signals having the operating frequencies. Optionally, the frequency synthesizer includes a voltage controlled oscillator (VCO), which receives the voltage applied by the electronic scanner to the receiving circuit, and outputs electric signals whose frequency is determined by the applied voltage, when a broadcast channel is detected. These one or more electric signals are sent to the transmitter 138, which uses the one or more operating frequencies to generate one or more transmission signals with sufficient power to effectively drive the power amplifier 142 which will be described below. According to a non-limiting example, the output power of the transmitter may set to the range between −4 dB to 0 dB.

The mixer 140 receives the alert signal from the tone generator and the transmission signal(s) from the transmitter, and encodes the alert signal into the transmission signal(s), to generate one or more modulated broadcast carrier signals. If the transmission signal is configured for creating an FM radio signal, the mixer 140 varies the frequency of the transmission signal at the frequency rate of the alert signal to yield the carrier signal. If the transmission signal is configured for creating an AM radio signal, the mixer 140 varies the amplitude of the transmission signal at the frequency rate of the alert signal to yield the carrier signal. In a variant, the carrier signals are the radio signals sent to the antenna for conversion into radio waves. In another variant, the one or more carrier signals are received by the power amplifier 142, which amplifies the one or more carrier signals, and outputs the one or more radio signals, as defined above in FIG. 1*a*. The one or more radio signals are the output of the radio signal generator 104 and are configured for being fed into the antenna device 106 of FIGS. 1*a* and 1*c*. The radio signal's power is chosen so that a radio wave generated by the antenna device in response to the radio signal can be received within a certain region surrounding the emergency vehicle (typically, but not limited to, about two or three city blocks—about 100 meters).

In the example of FIG. 4, the scanning is performed by two different frequency scanners (a first scanner 134 and a second scanner 135). The two frequency scanners operate simultaneously, and each frequency scanner scans a respective section of the desired frequency range. For example, if the FM radio band (88-108 MHz) is to be scanned, the first scanner 134 may scan the first frequency range (88.1-98.1 MHz) and the second scanner 135 scans the second frequency range (98.3-108.1 MHz). The use of two simultaneously-operating scanners reduces the time in which the desired frequency range is to be scanned, and thus enables the radio signal generator 104 to generate the desired radio signals in a shorter time interval. As explained above, shortening the scan time is advantageous, since the approach and passing of the emergency vehicle occurs in a brief period of time.

Optionally, a single frequency synthesizer 136 receives data indicative of the operating frequencies from both scanners 134 and 135, and generates signals having the operating frequencies. Alternatively, a pair of frequency synthesizers (not shown) is present, where each frequency synthesizer receives data indicative of the operating frequencies from a respective frequency scanner.

These signals are alternately (if one frequency synthesizer is present) or simultaneously (if two frequency synthesizers are present) transmitted to the first transmitter 138 and the second transmitter 139. The two transmitters operate independently from each other to generate respective transmission signals, as described above in FIG. 3. A first mixer 140 and a second mixer 141 receive the transmission signals from the first transmitter and second transmitter respectively, which create first and second transmission signals, respectively. The first mixer and the second mixer also receive the same alert signal from the tone generator, and encode the alert signal into the first and second transmission signals respectively, to generate first and second modulated broadcast carrier signals, respectively.

Each carrier signal is received by a respective isolation unit (144 and 145), which provide both attenuation and isolation of the carrier signals. The isolation units 144 and 145 isolate the respective carrier signal(s) from the other carrier signal(s), by attenuating and/or preventing unwanted harmonics that may be created in the signal combination process. The power amplifier 142 receives the isolated carrier signals from each transmitter and combines the isolated carrier signals together into a radio signal with sufficient power to create a radio wave having a desired spatial coverage.

Optionally, each isolation unit may include a parallel LC (inductor-capacitor) circuit and a series LC circuit. The LC circuit becomes resonant at a certain frequency determined by the inductor and capacitor component values. A series resonant circuit presents a very high impedance to its resonant frequency and a very low impedance to all other frequencies (band stop). A parallel resonant circuit will respond in an opposite manner to its resonant frequency; very low impedance to its resonant frequency and a high impedance to all other frequencies (band pass).

The series resonant circuit in the first isolation unit 144 is tuned to the second frequency range (scanned by the second scanner 135) to exhibit a very high impedance and isolation, preventing interference with the output in the first frequency range. The series resonant circuit in the second isolation unit 145 is tuned to the first frequency range (scanned by the first scanner 134) to exhibit a very high impedance and isolation, preventing interference with the second frequency range.

The parallel resonant circuit in the first isolation unit 144 is tuned to the first frequency range, and the parallel resonant circuit in the second isolation unit 145 is tuned to the second frequency range providing a low impedance and bandpass to their respective frequency ranges.

Thus, in the example of FIG. 4, the radio signal generator may create a single radio signal which may be used for simultaneously broadcasting the alert signal in two radio waves having different frequencies.

The radio frequency generator of FIG. 3 or 4 may scan a single band (AM or FM), or a sequentially scan plurality of bands. In the example of FIG. 4, the desired frequency range is scanned simultaneously by two scanners. Embodiments of the present invention are not limited to this example alone, and may include any number of scanners scanning the desired frequency.

Figure 5:
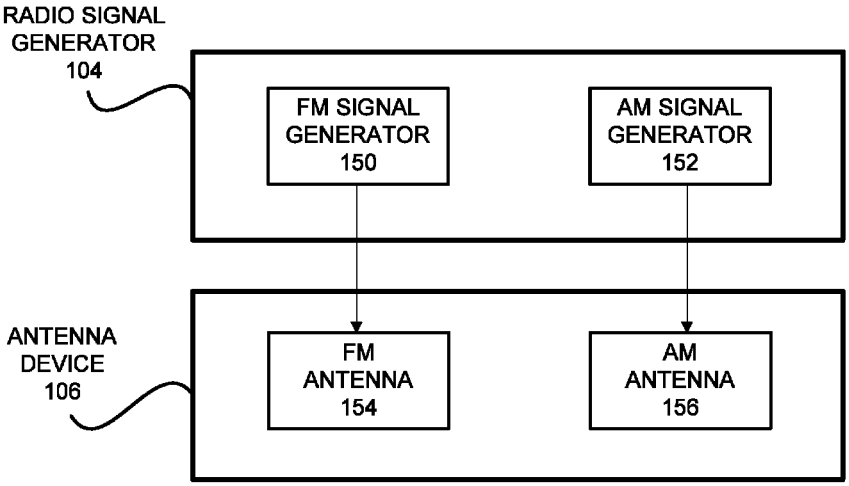
FIG. 5 is a block diagram illustrating an embodiment of the present invention, in which the warning system includes a frequency modulation (FM) transmitter and an amplitude modulation (AM) transmitter, each transmitter being associated with a respective antenna for transmitting the respective signal.

FIG. 5 is a block diagram illustrating an embodiment of the present invention, in which the radio signal generator 104 includes a frequency modulation (FM) signal generator 150 and an amplitude modulation (AM) signal generator 152. The antenna device 106 includes an FM antenna 154 and an AM antenna 156, configured for receiving radio signals from the FM signal generator 150 and the AM signal generator 152, and for converting the respective signals to respective radio waves. Each of the FM signal generator 150 and the AM signal generator 152 may be configured as the radio signal generator 104 described in FIG. 3 or 4.

Figure 6:
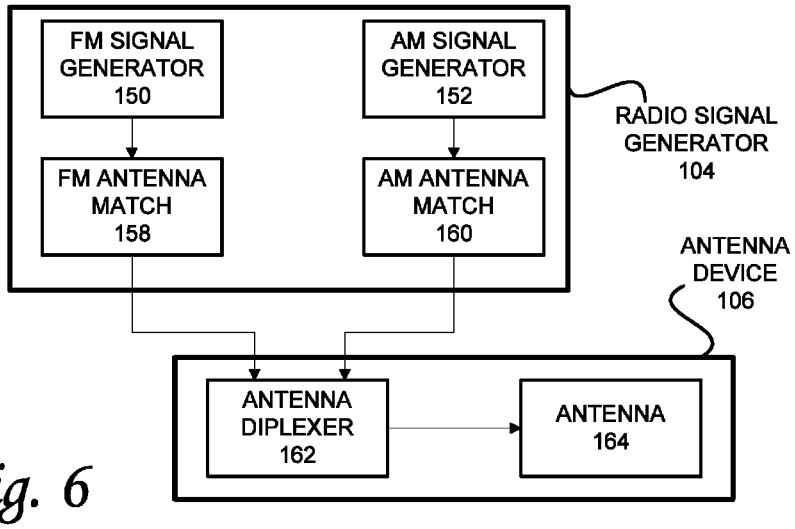
FIG. 6 is a block diagram illustrating an embodiment of the present invention, in which the FM transmitter and the AM transmitter are in communication with a common antenna via an antenna diplexer.

FIG. 6 is a block diagram illustrating an embodiment of the present invention, in which the FM signal generator 150 and the AM signal generator 152 are in communication with a common antenna 164 via an antenna diplexer 162. By obviating the need for a second antenna, the configuration of FIG. 6 may help conserve space in an enclosure of the system 100 enclosure and in the emergency vehicle.

In FIG. 6, the radio signal generator 104 includes a frequency modulation (FM) signal generator 150 and an amplitude modulation (AM) signal generator 152. Optionally, the FM radio signal generated by the FM signal generator 150 is fed into an FM antenna matching unit 158, and the AM radio signal generated by the AM signal generator 152 is fed into an AM antenna matching unit 160. Each antenna matching unit matches the output impedance of the respective (AM or FM) radio signal generator to an input impedance of the common antenna diplexer 162, for maximum power transfer. The impedance-matched radio signals output by the antenna matching units are received by the antenna diplexer 162, which combines the received signals for simultaneous or near-simultaneous broadcast over a single antenna 164.

Optionally, the diplexer 162 has two RF inputs; one for the AM frequencies and one for the FM frequencies. Each input section includes a parallel and a series LC (inductor-capacitor) resonant circuit. The LC circuit becomes resonant at a certain frequency determined by the inductor and capacitor component values. A series resonant circuit presents a very high impedance to its resonant frequency and a very low impedance to all other frequencies (band stop). A parallel resonant circuit will respond in an opposite manner to its resonant frequency; very low impedance to its resonant frequency and a high impedance to all other frequencies (band pass).

The series resonant circuit in the FM input is tuned to the AM frequency range to exhibit a very high impedance and isolation, preventing interference with the FM output. The series resonant circuit in the AM input is tuned to the FM frequency range to exhibit a very high impedance and isolation, preventing interference with the AM output. The parallel resonant circuit in the FM section is tuned to the FM frequency and the parallel resonant circuit in the AM section is tuned to the AM frequency providing a low impedance and bandpass to their respective frequency ranges.

Figure 7:
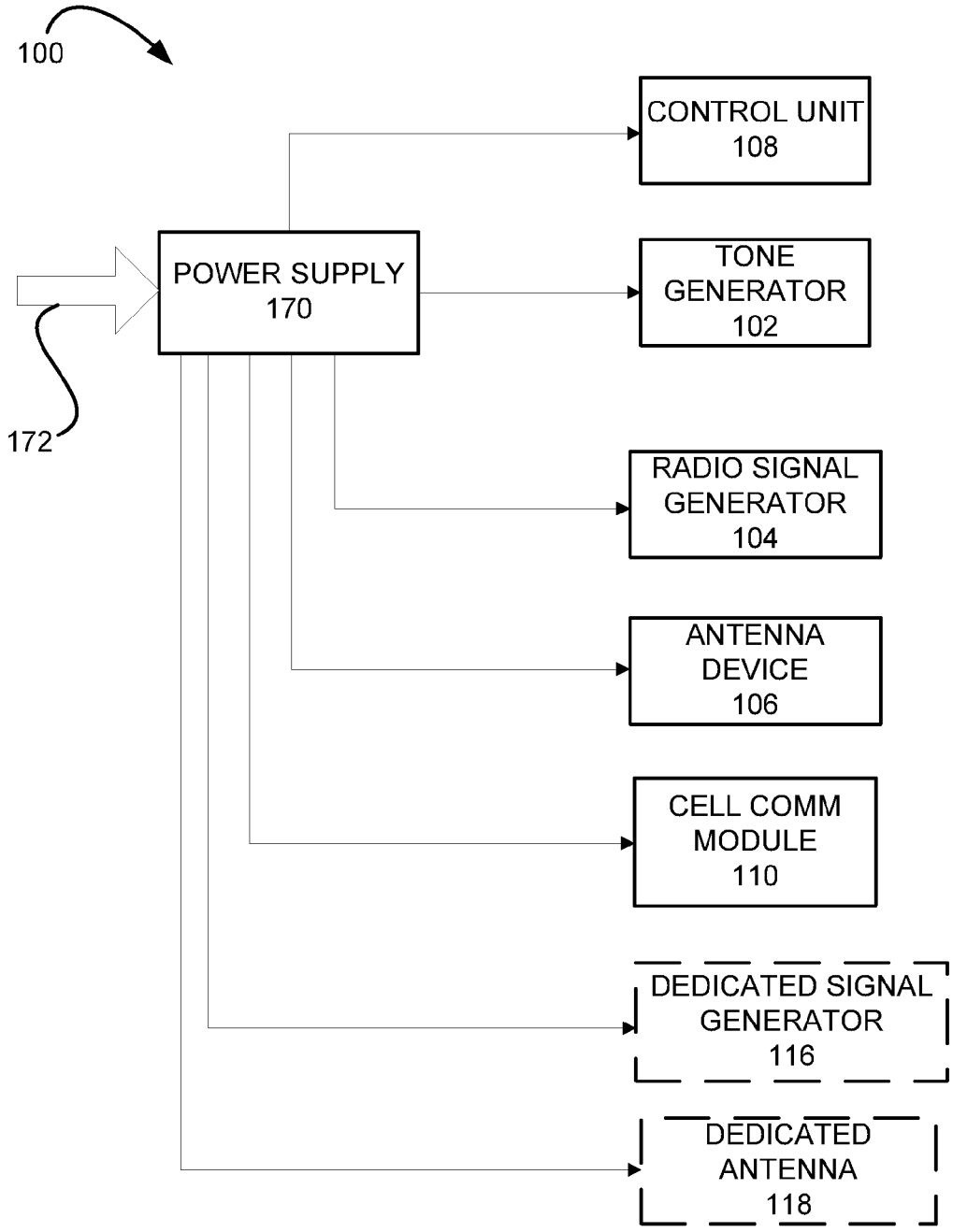
FIG. 7 is a block diagram illustrating an embodiment of the present invention, in which the warning system includes a power supply.

FIG. 7 is a block diagram illustrating an embodiment of the present invention, in which the warning system 100 includes a power supply 170. FIG. 7 is self-explanatory, and shows that the power supply 170 section receives a power signal 172 from the emergency vehicle's power system (generally a 12V power system), and manipulates the input power signal to provide suitable operating power to the various elements of warning system 100. The power supply 170 is connected to the different elements of the system 100 via respective power busses.

Figure 8:
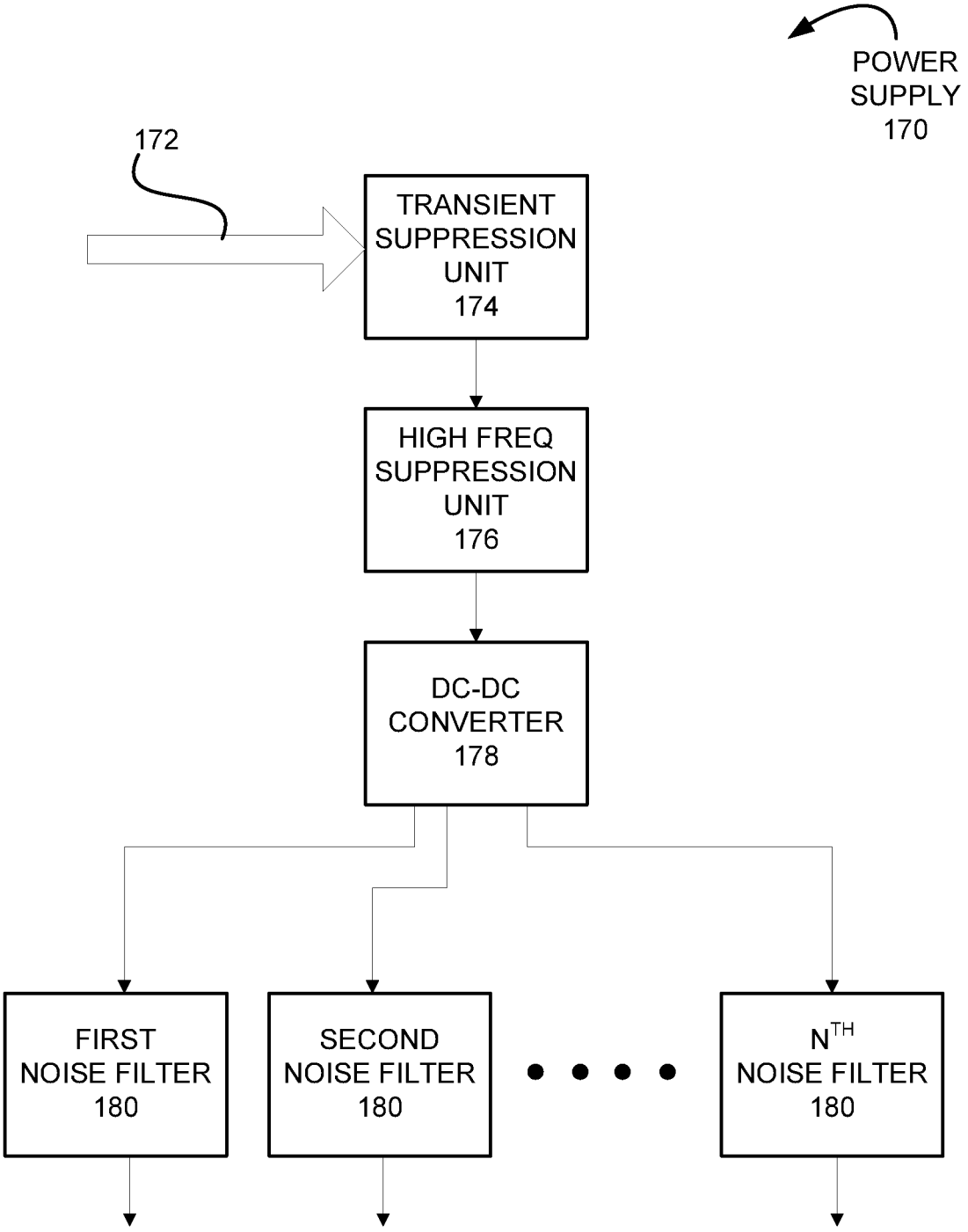
FIG. 8 is a block diagram illustrating an example of a power supply, according to some embodiments of the present invention.

FIG. 8 is a block diagram illustrating an example of a power supply 170, according to some embodiments of the present invention. In the example of FIG. 8, the power supply 170 includes a transient suppression unit 174 and a DC-DC converter 178. Optionally, the power supply includes a high-frequency suppression unit 176 and a plurality of noise filters (generally, 180).

The transient suppression unit 174 is configured for attenuating voltage spikes that are present and generated within the emergency vehicle's power system. For this purpose, the transient suppression unit may include a Pi LC filter network. Pi LC filters are commonly used in vehicle applications to suppress the extremely high energy transients generated by a number events resulting from changes in the current demands (i.e. ignition, lights on/off, etc.). The inductance (L) of the LC filter network presents an extremely high impedance to low frequency transients, and a low impedance to high frequency transients. The capacitance (C) acts in the opposite manner; an extremely low impedance to high frequency transients, and a high impedance to high frequency transients. Thus, the low frequency transients are blocked from the system and high frequency transients are shorted to ground, preventing most vehicle generated transients and noise from being applied the system power source.

A drawback of an LC filter network occurs when the values of the inductance and distributed capacitance between the spacing of the windings from the construction of the inductors' coil react together at one certain frequency known as the resonant frequency. At this frequency, the magnitude of any signal (i.e. noise, transients, etc.) is amplified to reach a magnitude which may be greater than a magnitude of the original power signal. These high-magnitude signals are generally high-frequency signals, and may be suppressed by the high-frequency suppression unit 176, if present, as described below.

The high-frequency suppression unit 176 receives the output of the transient suppression unit 174, and is configured for suppressing any high frequency noise signals that may be passed through the transient suppression unit 174. For this purpose, the high-frequency suppression unit 176 may include a capacitor filter, which presents a very low impedance to high frequency noise signals.

The DC-DC converter 178 is a buck regulator that receives the filtered DC vehicle system voltage from the high-frequency suppression unit 176, and generates the operating voltages for powering the different elements of the warning system 100. According to a non-limiting example, the DC-DC converter converts a 12V DC vehicle system voltage to a plurality of operating voltages of 5V DC and 3.3V DC for the warning system 100.

Optionally, the power supply 170 includes one or more filters (180), each applied to a respective operating voltage output by the DC-DC converter 178. Each filter provides additional filtering on each of the power busses which connect the power supply 170 to the different elements of the system 100. Each filter is configured to attenuate generated and induced noise signals. Each filter 180 may include one or more capacitors at multiple locations along the traces of the power supply on a PCB board. The values of the capacitors present a very low impedance to the high frequency noise signal and bypassing the noise to signal common (ground).

Figure 10:
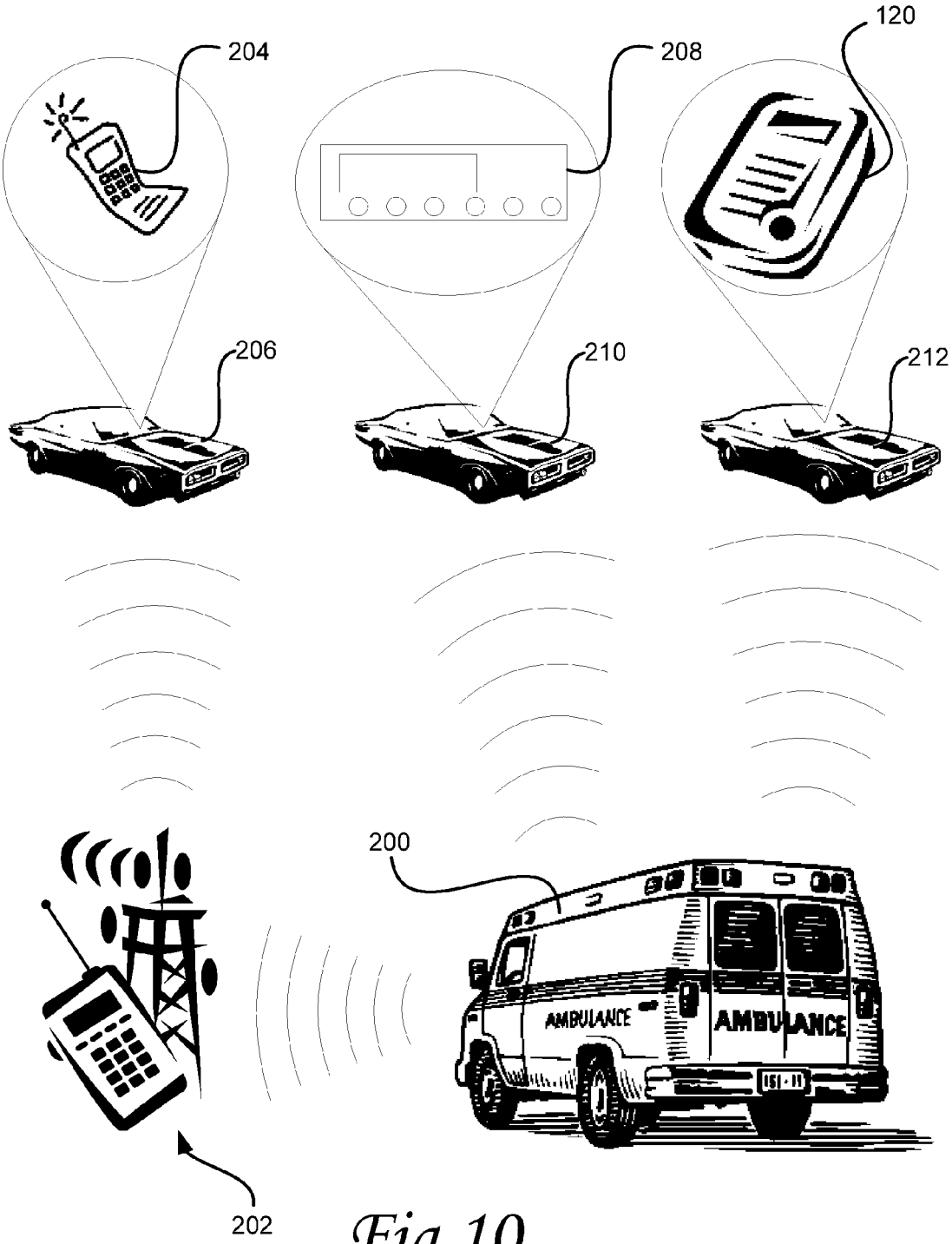
FIG. 10 is a schematic drawing illustrating the operation of a system of some embodiments of the present invention.

FIG. 10 is a schematic drawing illustrating the operation of a system of some embodiments of the present invention.

An emergency vehicle 200 carries the warning system 100 (not shown). When an initiating signal is received by a control unit controlling the warning system 100, the warning system operates as described above, and emits at least one of a cellular wave and a radio wave, as described above. The cellular wave is received by a cellular network 202. The cellular network extracts data indicative of the vehicle's position (position data) encoded in the cellular wave, and operates only one or more cellular towers located in the immediate geographical location of the system 100 (and therefore of the emergency vehicle) to transmit the cellular wave to a cellular phone 204, which is located in the vehicle 206 located within a desired range of the emergency vehicle.

The radio wave is received by a radio 208 tuned to any AM or FM radio station in a vehicle 210, as long the vehicle 210 is located within a desired range of the emergency vehicle.

Optionally, the warning system 100 also emits a third, dedicated signal, which is received by a dedicated receiver

120 located in a vehicle 212, as long as the vehicle 212 is located within a desired range of the emergency vehicle.

It should be noted that even though the system 100 has been described as a warning system for motorists, its emissions (waves) are also received by radios, cell phones, or dedicated receivers carried by pedestrians or cyclists. Thus, pedestrians or cyclists who may be talking on the phone or listening to radios may also be warned of the approach of the emergency vehicle.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A warning system for use in an emergency vehicle, the system comprising:

a tone generator, configured for generating an output alert signal; and a radio wave generator, configured for:

receiving the output alert signal and encoding the output alert signal into an electrical signal; and converting the electrical signal into an electromagnetic wave configured for being received by a radio and/or a cellular communication device within a desired distance from the emergency vehicle, thus enabling the receiving radio and/or cellular communication device to convert the electromagnetic wave to an audio signal that can be emitted by the radio and/or cellular communication device to warn a user of a proximity of the emergency vehicle;

wherein the radio wave generator comprises:

a radio signal generator, configured for generating one or more oscillating radio frequency electric currents, each having a respective frequency chosen to match a broadcasting frequency of one of a plurality of radio stations, and for encoding the alert signal in the one or oscillating radio frequency electric currents, thus generating one or more radio signals; and an antenna device, configured for receiving the one or more radio signals and converting one or more the radio signals into the respective one or more electromagnetic waves, each electromagnetic wave being a radio wave configured for being converted to the audio signal by a radio tuned a radio station having a broadcasting frequency matched by one frequency of the one or more oscillating radio frequency electric currents;

wherein the radio signal generator comprises:

a frequency scanner, configured scanning a certain range of frequencies of radio waves, and recognizing one or more operating frequencies corresponding to one or more of the broadcast frequencies of one or more of the radio stations;

a frequency synthesizer, configured for receiving from the frequency scanner data indicative of the one or more operating frequencies, and for generating one or more electric signals having the one or more operating frequencies;

a transmitter, configured for receiving the one or more electric signals from the frequency synthesizer and for generating respective one or more transmission signals having a desired power;

a mixer for receiving the alert signals and the one or more transmission signals and for encoding the alert signals into the one or more transmission signals, thus generating one or more modulated broadcast carrier signals, the one or more modulated broadcast carrier signals being used for producing one or more of the radio signals;

wherein the radio signal generator comprises a plurality of frequency scanners configured for simultaneously scanning respective sections of the desired range of frequencies;

and wherein:

the frequency synthesizer is configured for receiving the data indicative of the operating frequencies from the frequency scanners and alternately transmitting the electric signals to the plurality of transmitters;

each of the plurality of transmitters is configured for creating the respective transmission signal; and each of the mixers is configured for receiving the transmission signal from a respective one of the transmitters, and generating the respective modulated broadcast carrier signal.

2. The warning system of claim 1, wherein the radio signal generator comprises a plurality of frequency synthesizers, configured for receiving the data indicative of the operating frequencies from the corresponding frequency scanners, the frequency scanners simultaneously transmitting the electric signals to the respective plurality of transmitters.

3. The warning system of claim 1, wherein the radio signal generator comprises a plurality of isolation units, each isolation unit being configured for receiving a respective one of the carrier signals from the respective mixer, and for isolating the respective carrier signal from one or more carrier signal generated by other mixers.

4. The warning system of claim 1, wherein the radio signal generator further comprises a power amplifier, configured for amplifying the one or more carrier signals to generate and output the one or more radio signals.

5. The warning system of claim 1, wherein the plurality of frequency scanners is configured for scanning the respective sections of a single frequency band or of a plurality of frequency bands.

6. The warning system of claim 1, wherein the tone generator comprises:

a waveform generator, configured for creating a first alert signal having a first time profile; and a filter, configured for receiving the first alert signal and changing the first time profile, in order to output a desired second alert signal having a desired second time profile, the second alert signal being used for producing the output alert signal.

7. The warning system of claim 6, wherein the tone generator further comprises a decay generator, configured for introducing a decay in the second alert signal to generate the output alert signal.

8. A warning system for use in an emergency vehicle, the system comprising:

a tone generator, configured for generating an output alert signal; and a radio wave generator, configured for:

receiving the output alert signal and encoding the output alert signal into an electrical signal; and converting the electrical signal into an electromagnetic wave configured for being received by a radio and/or a cellular communication device within a desired distance from the emergency vehicle, thus enabling the receiving radio and/or cellular communication device to convert the electromagnetic wave to an audio signal that can be emitted by the radio and/or cellular communication device to warn a user of a proximity of the emergency vehicle;

wherein the radio wave generator comprises:

a plurality of radio signal generators, each radio signal generator being configured for generating one or more respective oscillating radio frequency electric currents having one or more respective frequencies chosen to match one or more broadcasting frequencies of one or more radio stations, and for encoding the respective alert signal in the one or more oscillating radio frequency electric currents, thus generating one or more respective radio signals; and a plurality of antenna devices, each antenna device configured for receiving the respective one or more radio signals and converting the respective one or more radio signals into respective one or more electromagnetic waves, the one or more electromagnetic waves being one or more radio waves configured for being converted to the audio signal by a radio tuned to one of the one or more the radio stations;

wherein the warning system comprises a plurality of antenna matches configured for matching an output impedance of the respective radio signal generator to an input impedance of an antenna diplexer; and wherein each of the antenna devices comprises a respective antenna diplexer and a respective antenna, the antenna diplexer being configured for receiving the signals from respective antenna matches and combining the received signals for simultaneous or near-simultaneous broadcast over the antenna.

9. A warning system for use in an emergency vehicle, the system comprising:

a tone generator, configured for generating an output alert signal; and a radio wave generator, configured for:

receiving the output alert signal and encoding the output alert signal into an electrical signal; and converting the electrical signal into an electromagnetic wave configured for being received by a radio and/or a cellular communication device within a desired distance from the emergency vehicle, thus enabling the receiving radio and/or cellular communication device to convert the electromagnetic wave to an audio signal that can be emitted by the radio and/or cellular communication device to warn a user of a proximity of the emergency vehicle;

wherein the radio wave generator comprises a cellular communication module comprising a position tracker and a cellular transmitter, wherein:

the position tracker is configured for generating position data indicative of the instantaneous location of the emergency vehicle;

the cellular transmitter is configured for:

generating an electric signal having a specific frequency matching the receiving frequency of a cellular network;

encoding the alert signal and position signal into electric signal to produce an encoded cellular signal; and converting the encoded cellular signal into the respective electromagnetic wave;

the electromagnetic wave is configured for being received by the cellular network, enabling the cellular network to extract the position data, and in response to the position data retransmit the electromagnetic wave via one or more cellular antennas located in an immediate geographical location of the emergency vehicle, such that one or more cellular communication devices located within a certain distance from the emergency vehicle are able to receive the retransmitted electromagnetic wave and convert the retransmitted electromagnetic to the audio signal.

10. The warning system of claim 9, wherein the tone generator comprises:

a waveform generator, configured for creating a first alert signal having a first time profile; and a filter, configured for receiving the first alert signal and changing the first time profile, in order to output a desired second alert signal having a desired second time profile, the second alert signal being used for producing the output alert signal.

11. The warning system of claim 10, wherein the tone generator further comprises a decay generator, configured for introducing a decay in the second alerts signal to generate the output alert signal.

12. The warning system of claim 9, wherein the radio wave generator comprises:

a radio signal generator, configured for generating one or more oscillating radio frequency electric currents having respective frequencies, each frequency chosen to match a corresponding broadcasting frequency of one of a plurality of radio stations, and for encoding the alert signal in the one or more oscillating radio frequency electric currents, thus generating one or more radio signal; and an antenna device, configured for receiving the one or more radio signals and converting each of the radio signals, into the respective electromagnetic wave, each of the electromagnetic waves being a radio wave configured for being converted to the audio signal by a radio tuned to a radio station having a broadcasting frequency matched by one frequency of the one or more oscillating radio frequency electric currents.

13. The warning system of claim 12, wherein the radio signal generator comprises:

a frequency scanner, configured scanning a certain range of frequencies of radio waves, and recognizing one or more operating frequencies corresponding to one or more of the broadcast frequencies of one or more of the radio stations;

a frequency synthesizer, configured for receiving from the frequency scanner data indicative of the one or more operating frequencies, and for generating one or more electric signals having the one or more operating frequencies;

a transmitter, configured for receiving the one or more electric signals from the frequency synthesizer and for generating respective one or more transmission signals having a desired power;

a mixer for receiving the alert signals and the one or more transmission signals and for encoding the alert signals into the one or more transmission signals, thus generating one or more modulated broadcast carrier signals, the one or more modulated broadcast carrier signals being used for producing one or more of the radio signals.

14. The warning system of claim 13, wherein the radio signal generator further comprises a power amplifier, configured for amplifying the one or more carries signals to generate and output the one or more radio signals.

15. The warning system of claim 13, wherein the radio signal generator comprises a plurality of frequency scanners configured for simultaneously scanning respective sections of the desired range of frequencies.

16. The warning system of claim 15, wherein the plurality of frequency scanners is configured for scanning the respective sections of a single frequency band or of a plurality of frequency bands.

17. The warning system of claim 12, comprising a plurality of radio signal generators, each configured for producing one or more radio signals, wherein:

the antenna device comprises a plurality of antennas, each antenna configured for receiving the radio signal from a respective one of the radio signal generators and for converting the radio signal into the respective electromagnetic wave.

18. A warning system for use in an emergency vehicle, the system comprising:

a tone generator, configured for generating an output alert signal; and a radio wave generator, configured for:

receiving the output alert signal and encoding the output alert signal into an electrical signal; and converting the electrical signal into an electromagnetic wave configured for being received by a radio and/or a cellular communication device within a desired distance from the emergency vehicle, thus enabling the receiving radio and/or cellular communication device to convert the electromagnetic wave to an audio signal that can be emitted by the radio and/or cellular communication device to warn a user of a proximity of the emergency vehicle;

a power supply configured for receiving an input power signal from a power system of the emergency vehicle, and manipulating the input power signal to provide suitable operating power to one or more elements of the warning system, the power supply comprising:

a transient suppression unit, configured for attenuating one or more voltage spikes of the input power signal, to output a first power signal; and a DC-DC converter, configured for receiving the first power signal, and for generates therefrom a plurality of output power signals of operating voltages suitable for powering the different elements of the warning system.

19. The warning system of claim 18, wherein:

the power supply further comprises a high-frequency suppression unit connecting the transient suppression unit and the DC-DC power converter, the high-frequency suppression unit being configured for filtering the first power signal, by suppressing one or more high frequency noise signals and transmitting the filtered first power signal to the DC-DC converter; and the DC-DC converter is configured for generating the plurality of output power signals from the filtered first power signal.

20. The warning system of claim 18, wherein the power supply further comprises one or more filters, each applied to a respective output power signal of the DC-DC converter, each filter being configured to attenuate generated and induced noise signals in the respective output power signal.

* * * * *